US005131861A

United States Patent [19]

Auclair et al.

[11] Patent Number: 5,131,861

[45] Date of Patent: Jul. 21, 1992

[54] THREADED TERMINAL CONNECTOR

[75] Inventors: William T. Auclair, Winsted; Randolph L. Auclair, New Hartford, both of Conn.

[73] Assignee: Electric Motion Company, Inc., Winsted, Conn.

[21] Appl. No.: 795,490

[22] Filed: Nov. 21, 1991

[51] Int. Cl.[5] ..... H01R 13/00

[52] U.S. Cl. ..... 439/218; 439/433

[58] Field of Search ..... 439/217-223, 439/389-434

[56] References Cited

U.S. PATENT DOCUMENTS

| | | | |
|---|---|---|---|
| 2,434,476 | 1/1948 | Sullivan | 439/388 |
| 3,688,245 | 8/1972 | Lockshaw | 439/436 |
| 3,717,839 | 2/1973 | Aldridge | 438/431 |

*Primary Examiner*—Joseph H. McGlynn

[57] ABSTRACT

A terminal connector for a ground wire employs a threaded sleeve. The sleeve is configured and dimensioned with a bore having threaded portions of different sizes so that the terminus of the ground wires of different sizes can be alternatively threaded to the sleeve. An extension connected to the sleeve includes an opening that is dimensioned for mounting the connector to a terminal post.

20 Claims, 1 Drawing Sheet

THREADED TERMINAL CONNECTOR

BACKGROUND OF THE INVENTION

This invention relates generally to electrical connectors employed for ground wires. More particularly, the present invention relates to electrical connectors which connect ground wires to terminal posts.

A number of devices and methods conventionally have been employed to connect solid ground wires to terminal posts. A common connector to which the invention relates comprises a terminal having a skirt-like stem and a petal-like plate extending from the stem. The plate has an opening which is dimensioned for insertion over a binding post or terminating point. The ground wire is inserted in the stem portion. The stem portion is then crimped against the ground wire to complete the electrical connection.

While many conventional terminals have provided acceptable connecting characteristics, ground wires having relatively large diameters such as No. 6 AWG solid ground wires have been more difficult to connect. Many conventional terminals are not readily installable in the field for use with large diameter ground wires. The large diameter ground wires are more difficult to bend around the terminal posts and connector devices of some form are advisable to ensure reliable ground connections. Conventional connectors mounted to the ends of the large diameter ground wires may become loose under certain mechanical loading conditions.

Furthermore, a conventional screw-on terminal is adapted to hold a wire having a certain diameter. Thus, an electrician is required to carry a variety of connectors in order to be prepared to connect ground wires of different sizes. This has proved to be problematic in practice, because field technicians commonly will run out of appropriately sized connectors, resulting in a delay in job completion and the expenditure of time associated with replenishing the connector supply.

SUMMARY OF THE INVENTION

Briefly stated, the invention in a preferred form is a connector for a ground wire. The connector is adapted to alternatively or interchangeably hold wires of different sizes or gauges, including large diameter wires. The connector includes a cylindrical sleeve having a central axis and an axial bore extending from a first end of the sleeve along at least part of the length of the sleeve. The bore is adapted to receive an end of a wire. The bore has at least a first threaded portion having a first length and a substantially constant first inner diameter. The bore also has a second threaded portion having a second length and a substantially constant second inner diameter that is different from the first inner diameter. The connector further includes an extension section extending from the sleeve. The extension section has a planar portion having an opening therethrough which is dimensioned to fit the terminal post of a ground terminal.

Both the sleeve and extension portion are formed from a conductive material. The sleeve is formed from a material having a hardness that is greater than the hardness of the wire to be inserted. Each portion of the threaded surface has a diameter corresponding to a given wire gauge so that a wire of the given gauge can be threadably received by the bore and engaged to the connector by applying a torque to the connector after insertion of the wire.

In another embodiment of the invention, a flexible electrical band conductor may connect with the sleeve. A terminal plate at the terminus of the flexible electrical connector includes a planar portion defining an opening dimensioned for connection with the terminal post.

An object of the invention is to provide a new and improved ground wire connector adapted for connecting ground wires to a terminal post or ground point.

Another object of the invention is to provide a new and improved electrical connector which provides an electrical ground connection of high integrity without requiring any special tools.

A further object of the invention is to provide a new and improved self-threading connector adapted for alternative or interchangeable use with ground wires having different diameters, the connector having an efficient construction and being adapted for easy installation in the field.

Other objects and advantages of the invention will become apparent from the drawings and the specification.

DETAILED DESCRIPTION OF THE PREFERRED EMBODIMENT

Figure 1:
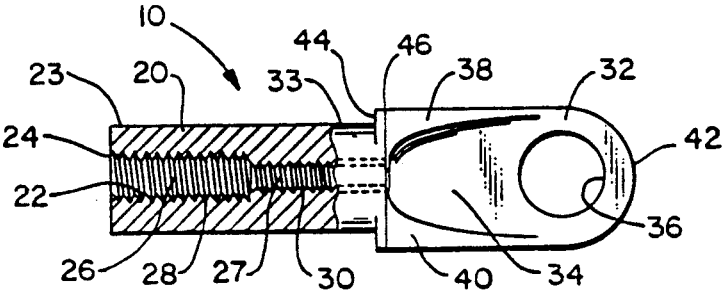
FIG. 1 is a top plan view, partly broken away and partly in section, of a terminal connector in accordance with the present invention.
Figure 2:
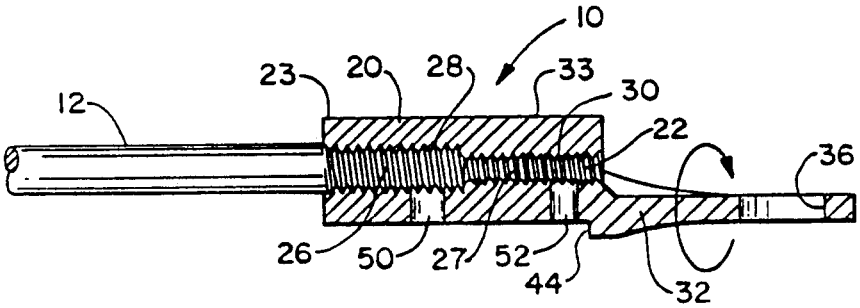
FIG. 2 is a side sectional view of the terminal connector of FIG. 1, the connector having a larger diameter ground wire mounted therein.
Figure 3:
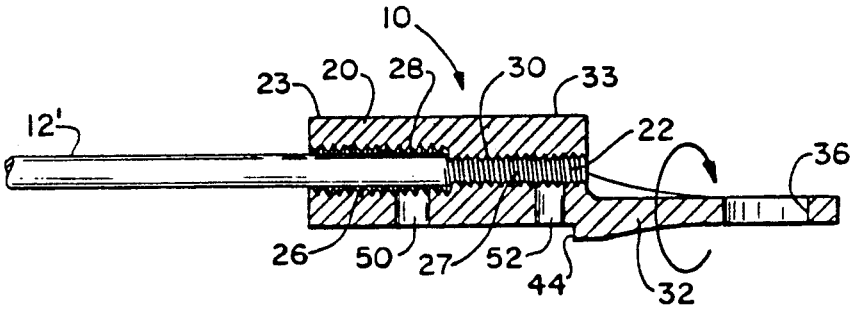
FIG. 3 is a side sectional view of the terminal connector of FIG. 1, the connector having a smaller diameter ground wire mounted therein.

With reference to the drawings wherein like numerals represent like parts throughout the figures, a terminal connector in accordance with the present invention is illustrated generally by the numeral 10 in FIGS. 1–3. The terminal connector is adapted for self-threading fastening to a end of a ground wire 12 for connecting the ground wire 12 to a ground point by securing the connector to a ground point or post (not illustrated). The invention as illustrated in the preferred embodiment has particular applicability in connecting No. 6 or 10 AWG ground wires.

Terminal connector 10 is a one-piece member formed of electrically conductive material such as, for example, copper plated with tin. The composite material of the portion of the connector adapted for holding a wire has a hardness greater than the hardness of the ground wire itself, so that the connector may self-tap into the ground wire terminus for threadable engagement, as will be described in further detail below.

The connector 10 includes a generally cylindrical sleeve 20. A bore 22 extends longitudinally through the center of the sleeve from a first wire-receiving end 23 of the connector 10, forming an opening 24 at the wire-receiving end 23. The bore can extend along the entire length of the sleeve 20, as shown in FIGS. 1–3, or can extend along only part of the length of the sleeve. A first threaded section 26 having a constant inner thread diameter extends from the opening 24 along part of the length of the sleeve 20 so as to generally define a wider portion 28 of the axial bore 22 of the sleeve 20. A second threaded section 27 having a constant inner thread diameter is adjacent to the first threaded section 26 in a longitudinal direction and extends further along the length of the sleeve 20 so as to define a narrower portion 30 along the length of the axial bore. The first and second threaded sections 26,27 are positioned relative to each other such that a wire that enters the first threaded section 26 can be pushed through the first threaded section 26 and into the second threaded section 27. Preferably, as shown in FIGS. 1–3, the first and second threaded sections 26,27 are co-axial. The threaded sections can, in combination, extend along the entire length of the bore 22, as shown in FIGS. 1–3, or, alternatively, the bore can include sections that are not threaded. In one embodiment of the invention, the first threaded section 26 is adapted to hold a No. 6 AWG wire which has a uniform diameter, and the second threaded section 27 is adapted to hold a No. 10 AWG wire which has a uniform diameter. The first threaded section 26 can be tapered slightly outward toward the opening 24 to facilitate insertion of the wire. It is noted that the degree of tapering preferably is very slight, e.g., a decrease from an inner thread diameter of 0.163 inches to an inner thread diameter of 0.0610–0.0612 inches.

A terminal extension 32 extends longitudinally from the second end 33 of the sleeve and includes a generally planar portion 34 proximate the rear edge 46 of the extension portion 32. A circular opening 36 is formed in the planar portion near the front edge 42 of the extension portion 32. The opening 36 is dimensioned for receiving a terminal post. The central axis of the circular opening 36 is preferably generally orthogonal to the central axis of the bore 22.

The end of the extension element that is connected to the sleeve 20 can be slightly contoured and includes skirt portions 38 and 40 which function to structurally fix the relative portions of the sleeve 20 and the extension 32 to thereby inhibit bending of the extension 32. The extension 32 has an arcuate shoulder 44 which projects from the sleeve 20 at the rear edge 46 of the extension 32. In some embodiments the skirt portions 38 and 40 are omitted, and the extension portion extends axially from the center of the sleeve 20.

The connector 10 is attached to the ground wire 12 by engaging the extension 32 and applying a torque around the axis of the sleeve 20, as shown by the arrow in FIGS. 2–3. As a result of this twisting, because the wire is formed from a softer material than the sleeve, the wire becomes threadably engaged with the sleeve. Torque is continually applied until the end of the ground wire is substantially fully received in the bore 22.

As shown in FIGS. 2–3, a first inspection hole 50 can be provided from the side of the sleeve 20 into the wider portion 28 of the bore 22, and a second inspection hole 52 can be provided from the side of the sleeve 20 into the narrowed portion 30 of the bore 22 so that the fully received position of the wire may be visually verified. The diameters of the threads of the bore are selected in accordance with the diameters of the ground wires to be insertable therein. In FIG. 2, a larger diameter wire 12 is shown in the bore 22. The uncoated end of the wire 12 extends along the first threaded section 26 of the bore, but not into the second threaded section 27. In FIG. 3, a smaller diameter wire 12' is shown. The end of the wire 12, extends through the first threaded section 26 of the bore 22 and into the second threaded section 27.

It should be appreciated that torque may be applied to the connector with a standard terminal wrench or an adjustable wrench and that no special tools are required to mount the connector to the end of the ground wire. It also should be appreciated that the bore can include threaded portions having more than two different inner diameter sizes.

After the wire has been attached to the connector 10, the connector 1 is joined to a terminal post or ground point by connecting the extension 32 so that the terminal post or ground point (not illustrated) projects through the opening 36 and is secured by torquing a nut or suitable locking element against the planar portion of the connector.

Figure 4:
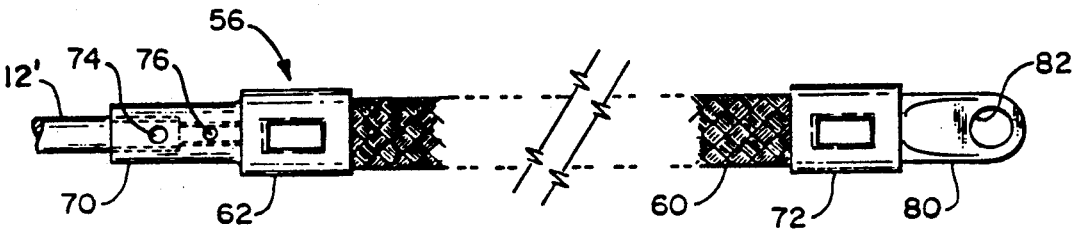
FIG. 4 is a top plan view, portions being removed, of a second embodiment of a ground wire connector in accordance with the present invention, the connector being mounted to an end portion of a smaller diameter ground wire.

A second embodiment of a terminal connector 56 illustrated in FIG. 4 employs a flexible conductor, in particular a band conductor 60. A connecting stud 62 which is crimped around conductor 60 is integrally joined to the sleeve 70. Sleeve 70 can be generally identical in form and function to that of sleeve 20. Sleeve 70 also can include first and second inspection holes 74,76 for visually verifying that the end of the ground wire has been appropriately threaded into the sleeve. A second stud 72 is crimped around conductor conductive band 60 with a terminal plate 80. Terminal plate 80 can integrally join to stud 72. Terminal plate 80 generally can be identical in form and function to extension 32 and preferably has a generally planar portion with an opening 82 for reception by the terminal post as previously described. The flexible wire connector can have standard lengths of, for example, three, six and nine inches or any other suitable length. Alternately, a flexible conductor such as a No. 6 flexible AWG wire may be employed in place of band conductor 60.

It should be appreciated that the foregoing terminal connectors 10 and 56 have an efficient construction and that a single connector can be used in the field in an efficient manner to provide alternative terminal connections for ground wires of different sizes or gauges. The ground connections provided by the terminal connectors of the invention have a high degree of mechanical and electrical integrity.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. An electrically conductive connector for alternatively connecting a wire having a first diameter and a wire having a different second diameter, comprising:

sleeve means having a wire-receiving end and a second end axially spaced from the wire receiving end, the sleeve means defining an axial bore, the bore being at least partially defined by a first axially extending threaded section having a substantially constant first inner thread diameter and a second axially extending threaded section having a substantially constant second inner thread diameter, the first and second inner thread diameters being different, and extension means connected to the sleeve means, the extension means having a planar portion defining an aperture.

2. The connector of claim 1, wherein the sleeve means is generally cylindrical and the extension means extends longitudinally from the sleeve means.

3. A connector according to claim 1, wherein the first threaded section and the second threaded section are co-axial.

4. The connector of claim 1, further comprising a wire formed from an electrically conductive material having a lesser degree of hardness than the sleeve.

5. The connector of claim 1 further comprising a wire having a generally uniform diameter, the wire being threadably engaged with one of the first threaded section and the second threaded section of the sleeve means by applying a torque to the connector.

6. The connector of claim 1, wherein the first threaded section is adapted to hold No. 6 AWG wire and the second threaded section is adapted to hold No. 10 wire.

7. The connector of claim 1, wherein the bore extends along the entire length of the sleeve means.

8. The connector of claim 7, wherein the combination of the first threaded section and the second threaded section extend along the entire length of the bore.

9. The connector of claim 1, wherein the sleeve means has hole means defining a first inspection hole extending radially from one of the first and second threaded sections.

10. The connector of claim 9, wherein the hole means further defines a second inspection hole extending radially from the other of, the first and second threaded sections.

11. An electrical connector for alternatively holding wires of different sizes, comprising:

sleeve means having a wire-receiving end and a second end axially spaced from the wire receiving end, the sleeve means defining an axial bore, the bore being at least partially defined by a first axially extending threaded section having a substantially constant first inner thread diameter, and a second axially extending threaded section having a substantially constant second inner thread diameter, the first and second inner thread diameters being different, flexible conductor means for forming a flexible electrical conductor having opposite first and second ends, first connection means attached to the second end of the sleeve means for electrically connecting the sleeve means and the first end of the conductor means, extension means having a planar portion defining an aperture, and second connection means connecting the second end of the conductor means to the extension means.

12. The connector of claim 11, further comprising a wire formed from a second electrically conductive material having a lesser degree of hardness than the first electrically conductive material.

13. The connector of claim 11 further comprising a wire having a generally uniform diameter, the wire being threadably engaged with one of the first threaded section and the second threaded section of the sleeve means by applying a torque to the connector.

14. The connector of claim 11, wherein at least one of the first and second connection means connects the conductor means by a crimped engagement.

15. The connector of claim 11, wherein the flexible conductor is a band conductor.

16. The connector of claim 11, wherein the first threaded section is adapted to hold No. 6 AWG wire and the second threaded section is adapted to hold No. 10 AWG wire.

17. The connector of claim 11, wherein the bore extends along the entire length of the sleeve means.

18. The connector of claim 17, wherein the combination of the first threaded section and the second threaded section extend along the entire length of the bore.

19. The connector of claim 11, wherein the sleeve means has hole means defining a first inspection hole extending radially from one of the first and second threaded sections.

20. The connector of claim 19, wherein the hole means further defines a second inspection hole extending radially from the other of the first and second threaded sections.

* * * * *